United States Patent [19]

Runyan et al.

[11] 3,995,757

[45] Dec. 7, 1976

[54] MACHINE FOR FEEDING STACKED ARTICLES

[75] Inventors: Kenneth R. Runyan, Dayton; Quentin E. Honnert, Cincinnati; Ronald H. Porter, Milford, all of Ohio

[73] Assignee: Multifold-International, Inc., Milford, Ohio

[22] Filed: June 27, 1975

[21] Appl. No.: 590,951

Related U.S. Application Data

[62] Division of Ser. No. 437,167, Jan. 28, 1974, Pat. No. 3,907,273.

[52] U.S. Cl. ..... 214/309; 214/87; 214/89; 214/95 R; 214/654

[51] Int. Cl.[2] ..... B65G 47/61

[58] Field of Search ..... 214/650 R, 89, 309, 214/95 R, 654, 87, 88, 91 R, 761, 658

[56] References Cited

UNITED STATES PATENTS

| | | | |
|---|---|---|---|
| 2,281,012 | 4/1942 | Sears | 214/654 |
| 2,690,337 | 9/1954 | Halahan | 271/159 |
| 3,272,347 | 9/1966 | Lemelson | 214/1 CM |
| 3,905,494 | 9/1975 | Tamura | 214/89 |

*Primary Examiner*—Robert J. Spar
*Assistant Examiner*—George F. Abraham
*Attorney, Agent, or Firm*—James W. Pearce; Roy F. Schaeperklaus

[57] ABSTRACT

A machine which takes upright stacks of flat articles such as carton blanks or the like from a pallet, straightens each stack, and feeds the articles from the stack in a shingled stream. The machine includes a crane which is programmed to pick up stacks from a plurality of locations on the pallet. Each stack is transferred to a conveyor which first advances the stack to a stack straightening device which tips the stack from upright to horizontal position to separate articles in the stack and straightens and centers the stack. The stack is then restored to upright position on the conveyor and is advanced to elevators which raise the stack against a pick-off belt which withdraws articles from the top of the stack in a stream shingle-fashion. The stream is directed around a drum which inverts the articles in the stream, and the stream is discharged.

7 Claims, 12 Drawing Figures

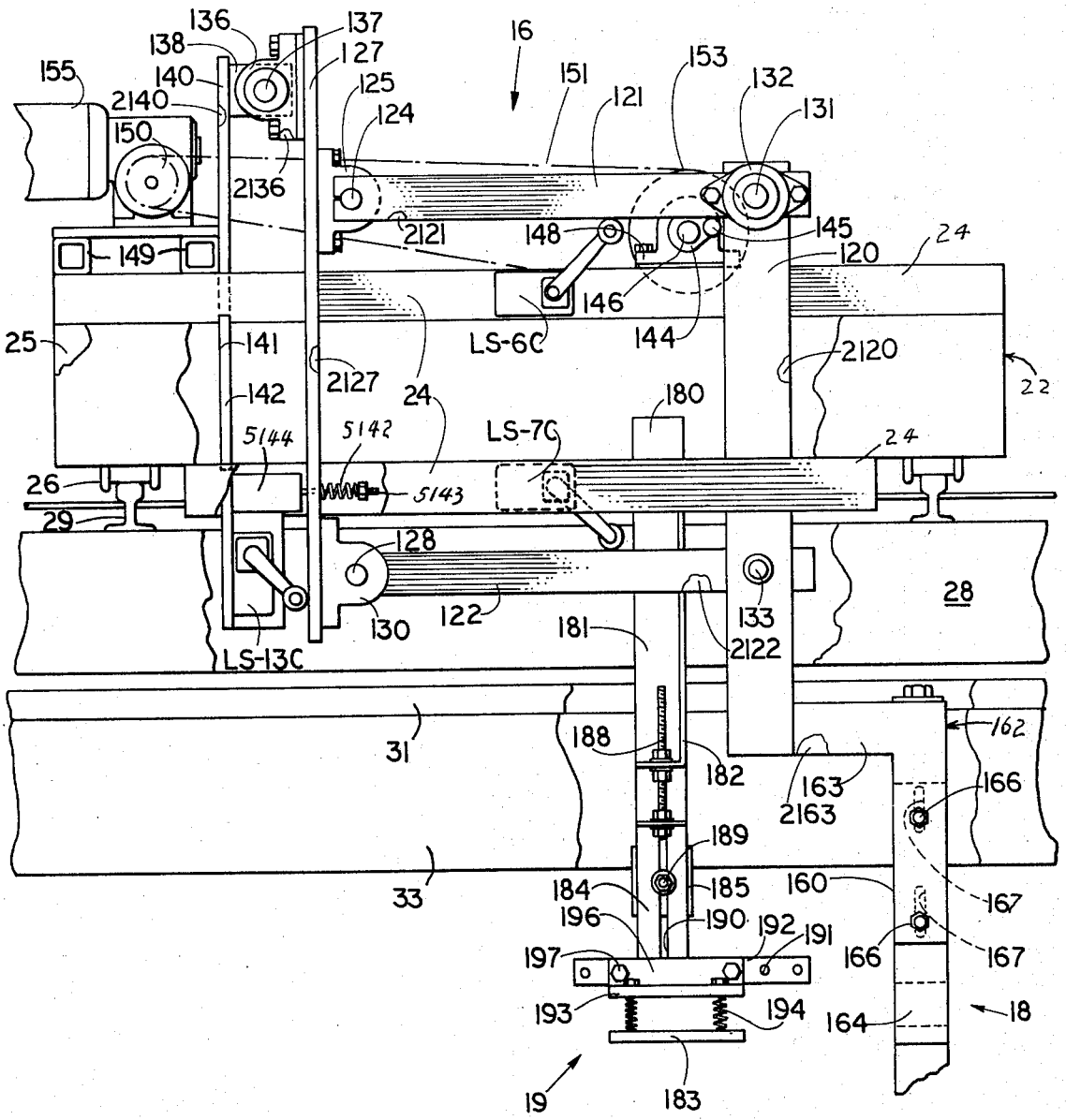
FIG. 5
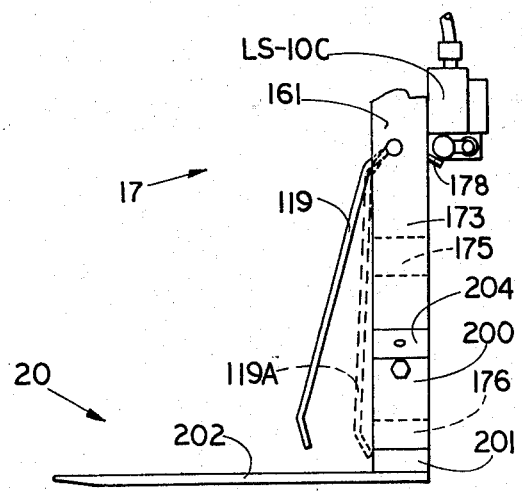

MACHINE FOR FEEDING STACKED ARTICLES

This is a division of our copending application Ser. No. 437,167, filed Jan. 28, 1974 now U.S. Pat. No. 3,907,273 issued Sept, 23, 1975.

This invention relates to a machine for transferring flat articles from a stack into a flowing stream of articles in a shingled relation.

An object of this invention is to provide a machine which can transfer a stack of articles from a skid or the like to elevators which raise the stack to a pick-off device which feeds the articles off the top of the stack in shingled relation.

A further object of this invention is to provide such a machine which inverts the articles as the articles are fed from the pick-off device.

A further object of this invention is to provide such a machine in which the stack is swung from upright position to horizontal position before it is advanced to the elevator to permit inspection and straightening of sides of the stack and removal of misformed or deformed articles.

A further object of this invention is to provide such a machine in which a stack which has been straightened is advanced to and held at a standby station adjacent the elevator while a preceding stack is being discharged and is advanced to the elevator when the elevator is ready to receive the stack.

Briefly, this invention provides a machine which includes a crane which lifts stacks of flat articles such as carton blanks or the like from a skid. The crane is arranged to progressively pick up stacks from the skid, one at a time. The crane raises a selected stack from the skid and moves the stack to a transfer table at which the stack is lowered onto transfer belts. The transfer belts move the stack in one direction onto a tip-over or tilt table which swings the stack from upright to horizontal position to permit inspection of the stack and removal of improperly formed or deformed cartons from the stack. At the tilt table, stack straightening pads move against sides of the stack to straighten the stack. Then, the tilt table returns the stack to upright position and the stack is advanced to a standby position where the stack waits until an elevator is ready to receive the stack. When the stack is advanced to the elevator, the elevator raises the stack against a pick-off device which feeds carton blanks off the top of the stack in overlapping shingled relation. The carton blanks are advanced around a drum which inverts the shingled carton blanks and the carton blanks are discharged in a shingled stream.

The above and other objects and features of the invention will be apparent to those skilled in the art to which this invention relates from the following detailed description and the drawings, in which:

FIG. 5 is a view in side elevation of a crane structure of the machine looking in the direction of the arrows 5—5 in FIG. 2, parts being broken away to reveal details of structure;

In the following detailed description and the drawings, like reference characters indicate like parts.

GENERAL DESCRIPTION

Figure 1:
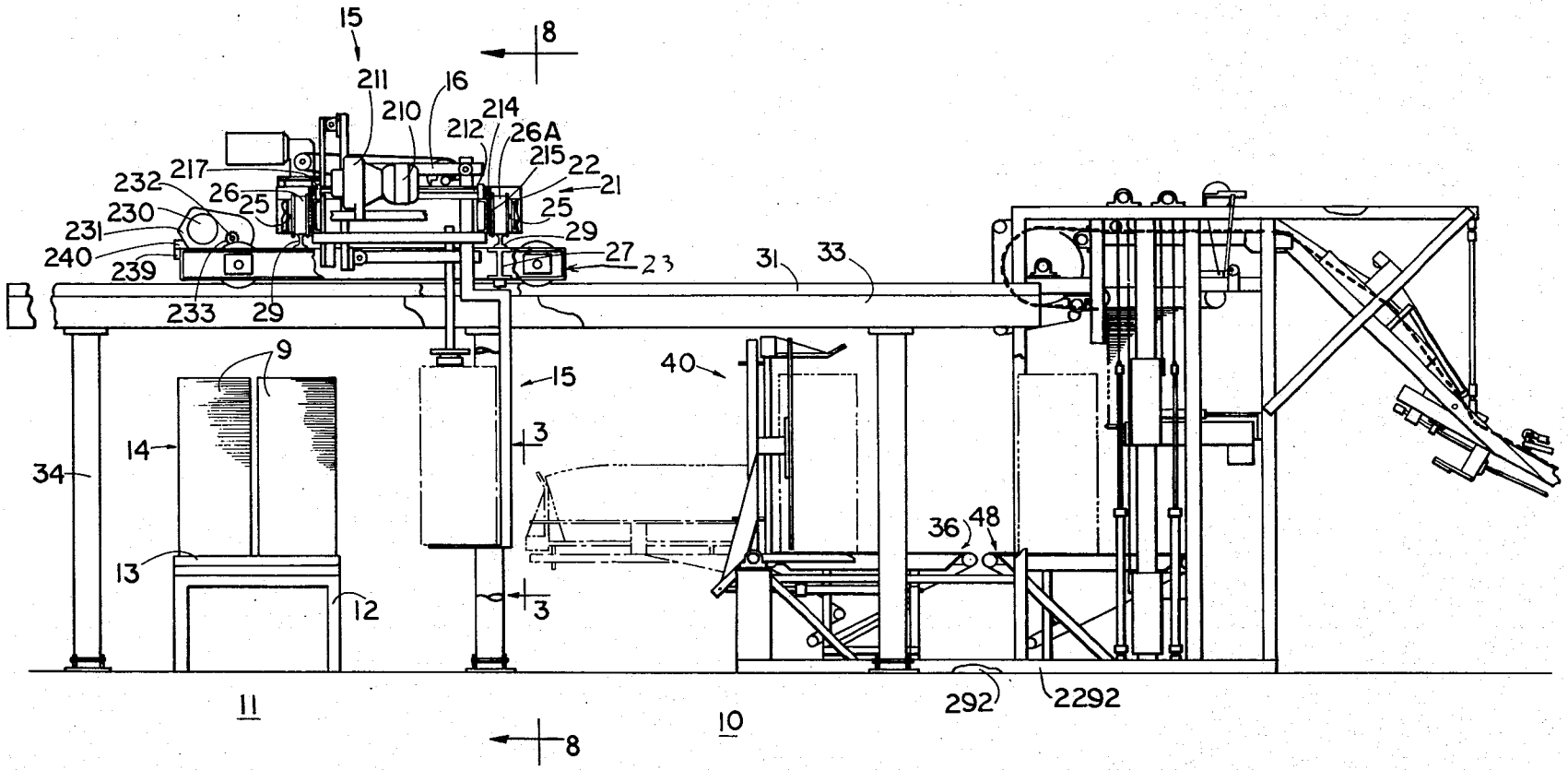
FIG. 1 is a somewhat schematic view in side elevation of a carton de-stacking machine constructed in accordance with an embodiment of this invention, parts of a crane guiding track and of a discharge conveyor being broken away, a tip-over table of the machine being shown in lowered position in dot-dash lines.

In FIG. 1 is shown a machine 10 for transferring articles from a stack to a shingled stream which is constructed in accordance with an embodiment of this invention. The machine 10 can direct cartons into a customer machine generally located to the right of FIG. 1 and not shown. The cartons are picked up as right side up vertical stacks 9 and delivered to the customer machine in a sequenced or shingled procession, each carton being face down as the cartons are delivered by the machine.

Figure 2:
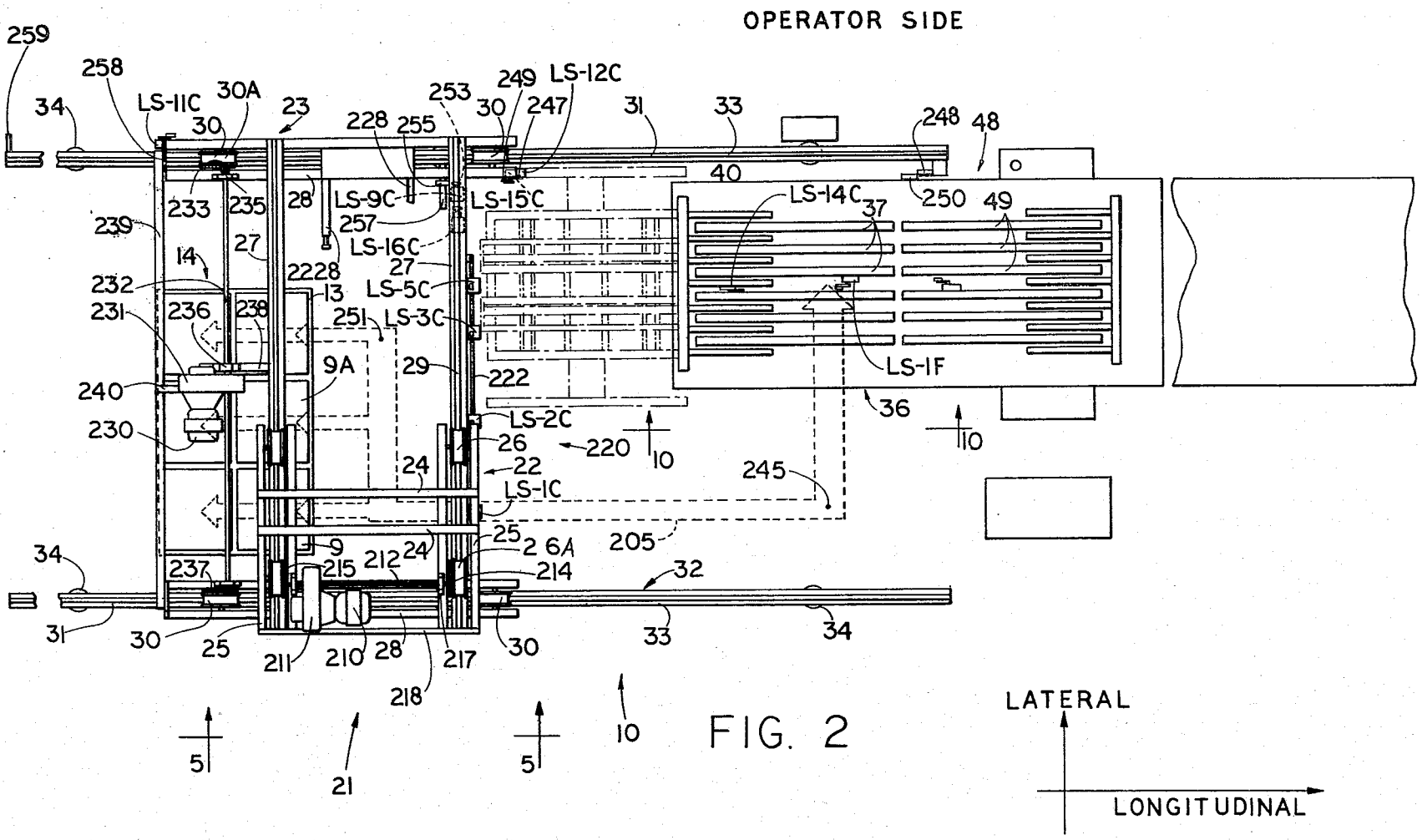
FIG. 2 is a somewhat schematic plan view of a crane area and a transfer table of the device, the path of a crane being shown in dashed lines, the tip-over table being shown in full lines in raised position and in dash-dot lines in lowered position.

Generally moving from left to right in FIGS. 1 and 2, the machine 10 provides a loading station 11 (FIG. 1) comprising a rigid pallet stand 12, a wooden pallet 13 (FIGS. 1 and 3) on the top of the pallet stand 12, and an array of carton stacks 14 (FIG. 1) on the pallet 13. An ordinary fork lift truck (not shown in detail) delivers the pallet 13 and the array of cartons 14 on the pallet to the pallet stand 12 which positions the pallet 13 in such a way to permit an automated crane 15 (FIGS. 1 and 8) to sequentially unload the individual carton stacks 9 (FIG. 1).

Figure 4:
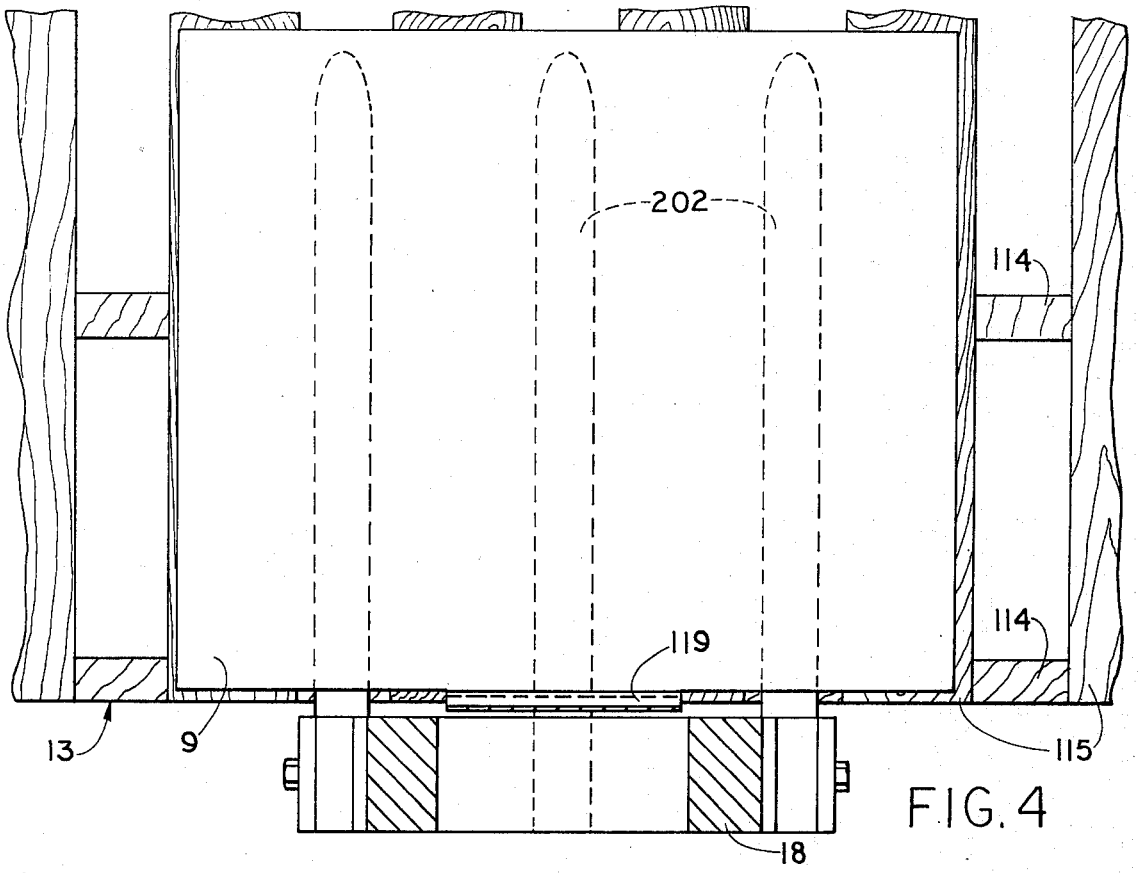
FIG. 4 is a view in section taken on the line 4—4 in FIG. 3.

The automated crane 15 and a mobile mounting structure 21, by action of a sequential programmer, automatically picks up the stacks of cartons 9 from a series of different locations on the pallet 12 (FIG. 1) and delivers them to one fixed drop position. Dashed arrows in FIG. 2 show the path of the automated crane 15. Programming can be arranged to handle carton arrays of less than or more than the six stacks shown, but the invention will be described with reference to programming in connection with the array shown. The automated crane 15 includes two major sections; an upper support section 16 (FIG. 5) and a lower stack supporting section 17. The upper section 16 is a support structure for the lower section 17. The lower section 17 provides a vertically disposed structure 18, a stack clamp 19, and a fork 20. The upper section 16 provides the small vertical movements necessary to raise the fork 20 under the carton stack 9 (FIG. 3) to lift the carton stack 9 off the pallet 13. In a reverse movement it also unloads the crane 15. The upper section 16 (FIG. 5) also permits a small horizontal movement of the crane section 17 in the event that the fork lift 20 would improperly impact the pallet 13 or the pallet stand 12 and includes a limit switch LS-13C which stops advance of the crane assembly. The vertically disposed structure 18 provides a vertical support for the stack of cartons 9. The stack clamp 19, which does not move vertically, is engaged by the top of the carton stack 9 as this stack is lifted from the pallet 13 by the forks 20. The fork 20 is so constructed that its tongues fit between parallel runners 115 of the pallet 13 when the fork is moved under the carton stack 9 as shown in FIG. 4.

The crane 15 is advanced along the path shown by dashed arrows in FIG. 2 by the mobile mounting structure 21 (FIG. 1). The structure 21 includes an upper truck assembly 22 (FIGS. 2 and 8) and a lower truck assembly 33 (FIGS. 1 and 2). The upper truck assembly 22 includes box beams 24 (FIG. 2) supported by a transverse I beam assembly 25, and a set of rollers 26 mounted upon the beams 25. A pair of rails 29 supports the rollers 26. The lower truck assembly 23 generally supports the upper truck 22 and includes the rails 29, a set of transverse beams 27 which underlie the rails 29, an assembly of longitudinal beams 28, and a set of rollers 30 mounted upon the beams 28 for mobility thereof. The rollers 30 of the mobile mounting structure 21 are supported and move upon a pair of rails 31 of an overall truck support assembly 32. The overall truck support assembly 32 provides a pair of longitudinal beams 33 that support the rails 31, and a set of pillars 34 that support the beams 33 in fixed relationship with other major parts of the feeder machine 10.

The automated crane 15 delivers the stack of cartons 9 to a fixed drop position, a deposit table 36. The deposit table 36 supports a set of timing belts 37 (see FIG. 2). A support structure assembly 38 for the table 36 (FIG. 10) includes drive mechanism for driving the belts 37 in both counterclockwise and clockwise directions. Counterclockwise movement of the belts 37 moves the stack of cartons 9 off the fork 20 and into a stack straightening tip-over device 40. Clockwise movement of the belts 37 moves the stack of cartons out of the straightening device 40, across the drop position of the deposit table 36 and onto a holding or stand-by table 48.

The stack straightening device 40 aligns the individual cartons of stack 9 with each other to form a perfect "board straight" stack on all sides for non-jamming processing through later stages of the machine 10. The straightening device 40 also places the entire stack of cartons 9 on the center line of the deposit table 36.

The machine which has been discussed in general terms hereinabove will now be described in greater detail. In the drawings, particularly FIG. 2, one side of the machine has been designated "Operator Side" for ease of reference. In the description, movement toward and away from the operator side is designated "lateral" movement. Movement perpendicular thereto, as indicated in FIG. 2, is designated "longitudinal".

PALLET AND AUTOMATED CRANE

As already pointed out, as shown in FIGS. 1 and 2, the feeder machine 10 provides a loading station 11 comprising a rigid pallet stand 12, a wooden pallet 13 on the top thereof, and an array of carton stacks 14.

Figure 3:
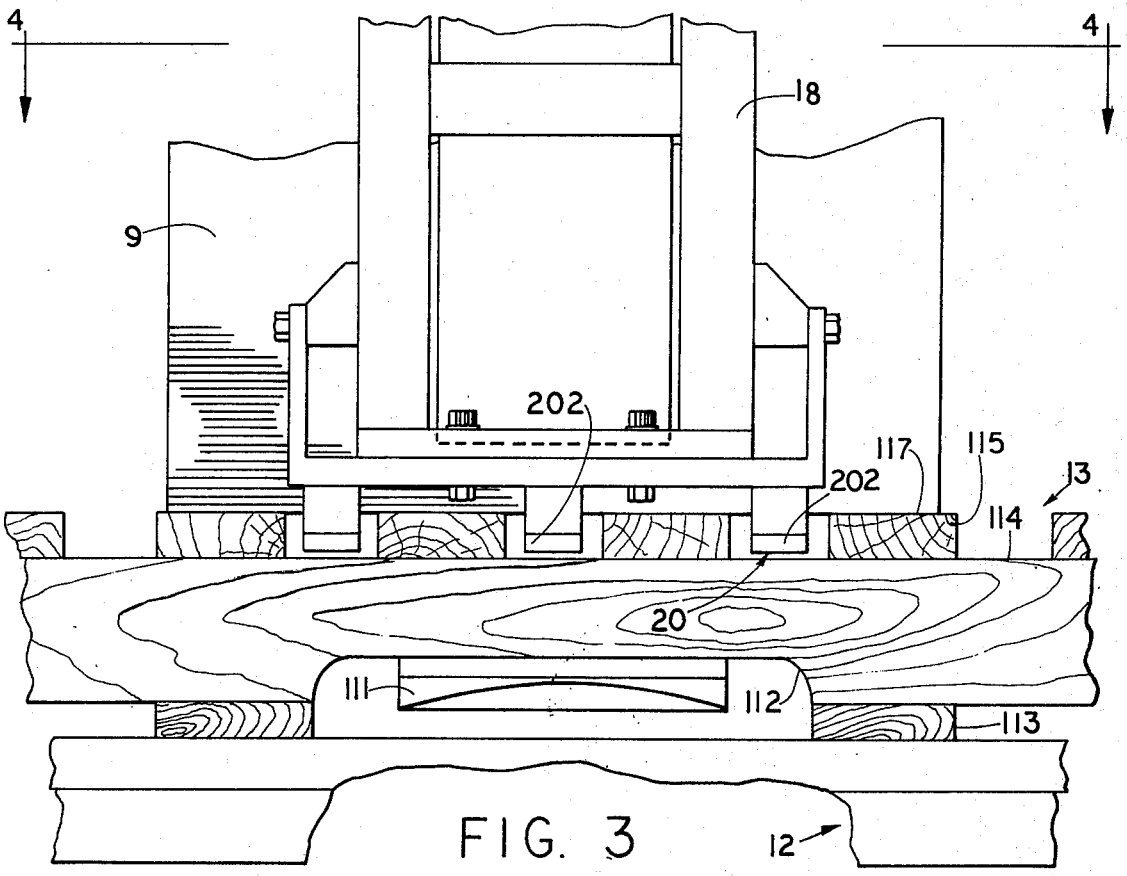
FIG. 3 is a view in elevation on an enlarged scale looking in the direction of the arrows 3—3 in FIG. 1 with a crane being in lowered position and in position to pick up a stack of cartons on a skid, a fragmentary portion of a fork of a lift truck being shown in association therewith.

The rigid pallet stand 12 (FIGS. 2 and 3) is so disposed that the carton array 14 is placed in alignment with the fork 20 of the crane 15. Referring to FIG. 3, tongues 111 of a fork lift truck (not shown in detail) can extend through a pair of slots 112, only one of which is shown, of the pallet 13 to permit placing the pallet 13 on the stand 12 without moving the carton array 14 in relation with the pallet 13. The bottom runners 113 hold a set of cross members 114 in rigid relation with each other. The plurality of top runners 115 provides a discontinuous bearing surface 117 upon which the carton stacks 9 can rest. Each carton stack 9 is therefore suspended above the cross members 114 to provide free and aligned passage for tongues 202 of the fork 20 to enter under the carton stack 9. As can be seen in FIG. 4, the tongues 202 continue to enter under the carton stack 9 until the face of the carton stack 9 is engaged by a limit switch compression plate 119 to depress the plate 119 to the dashed line position 119A of FIG. 5 which stops the progress of crane 15, as will be explained more fully hereinafter. The automated crane 15 then raises the fork 20 sufficiently to lift the stack of cartons 9 off the pallet assembly 13. In so doing, the stack of cartons 9 may shift toward the vertical structure 18 and is retained thereagainst. The crane 15 will then travel and deposit the stack 9 in its deposit position and then return, index and pick up the next stack of cartons in the array 14. This process will be described in further detail hereinafter.

The array of cartons 14 can contain two rows, i.e., two stacks of cartons 9 will be in longitudinal line with each other on the pallet 13 (see FIG. 2). The number of columns, i.e., the number of carton stacks 9 set laterally of each other on the pallet 13, can be varied from 2 to 4 depending on the size of the cartons bein processed. Hereinafter an array of cartons 14 using 2 rows and 3 columns will be described in detail. Other array sizes could be employed with minor modification to controls of the automated crane 15 and the support system 21.

Figure 6:
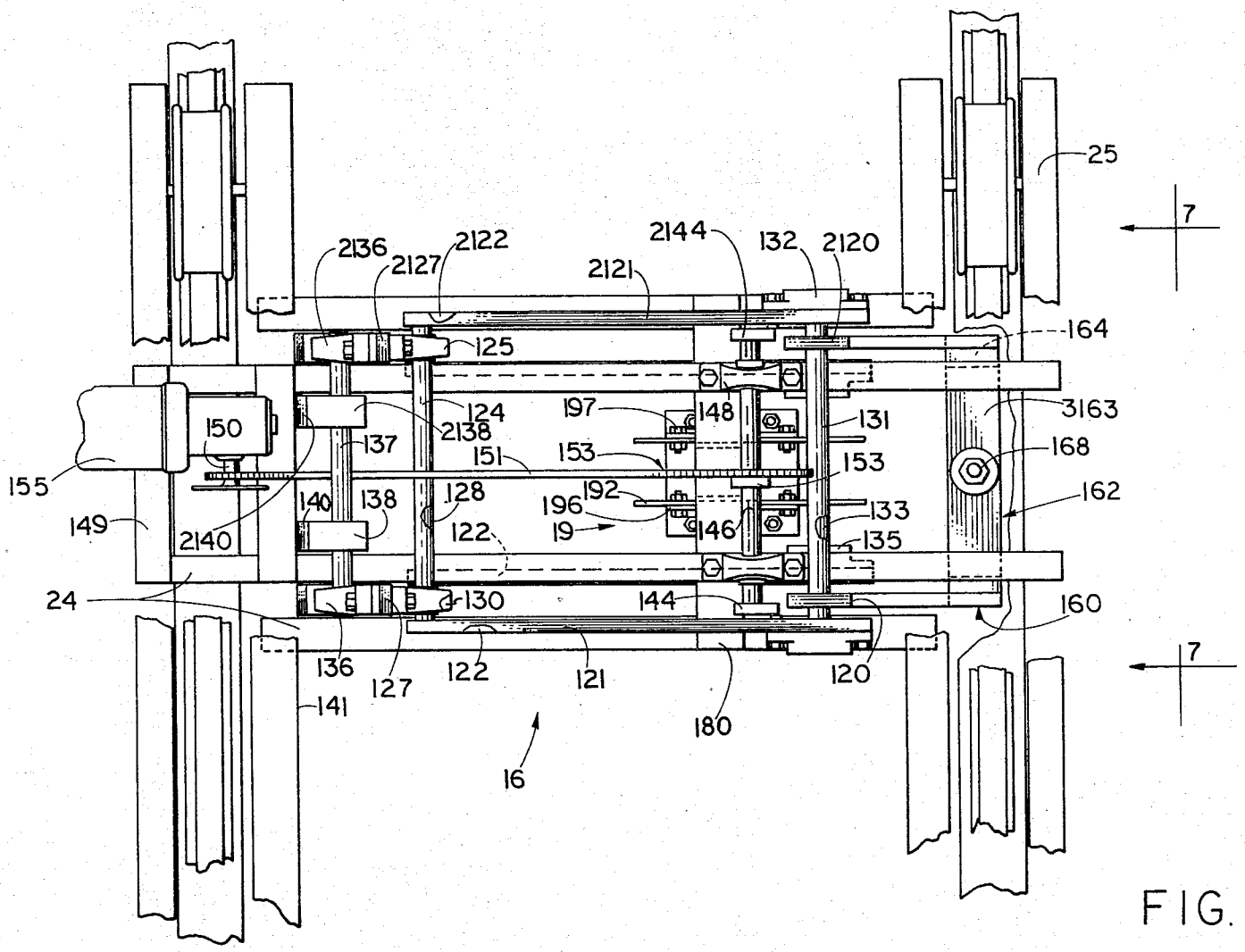
FIG. 6 is a fragmentary plan view of the crane structure shown in FIG. 5.
Figure 7:
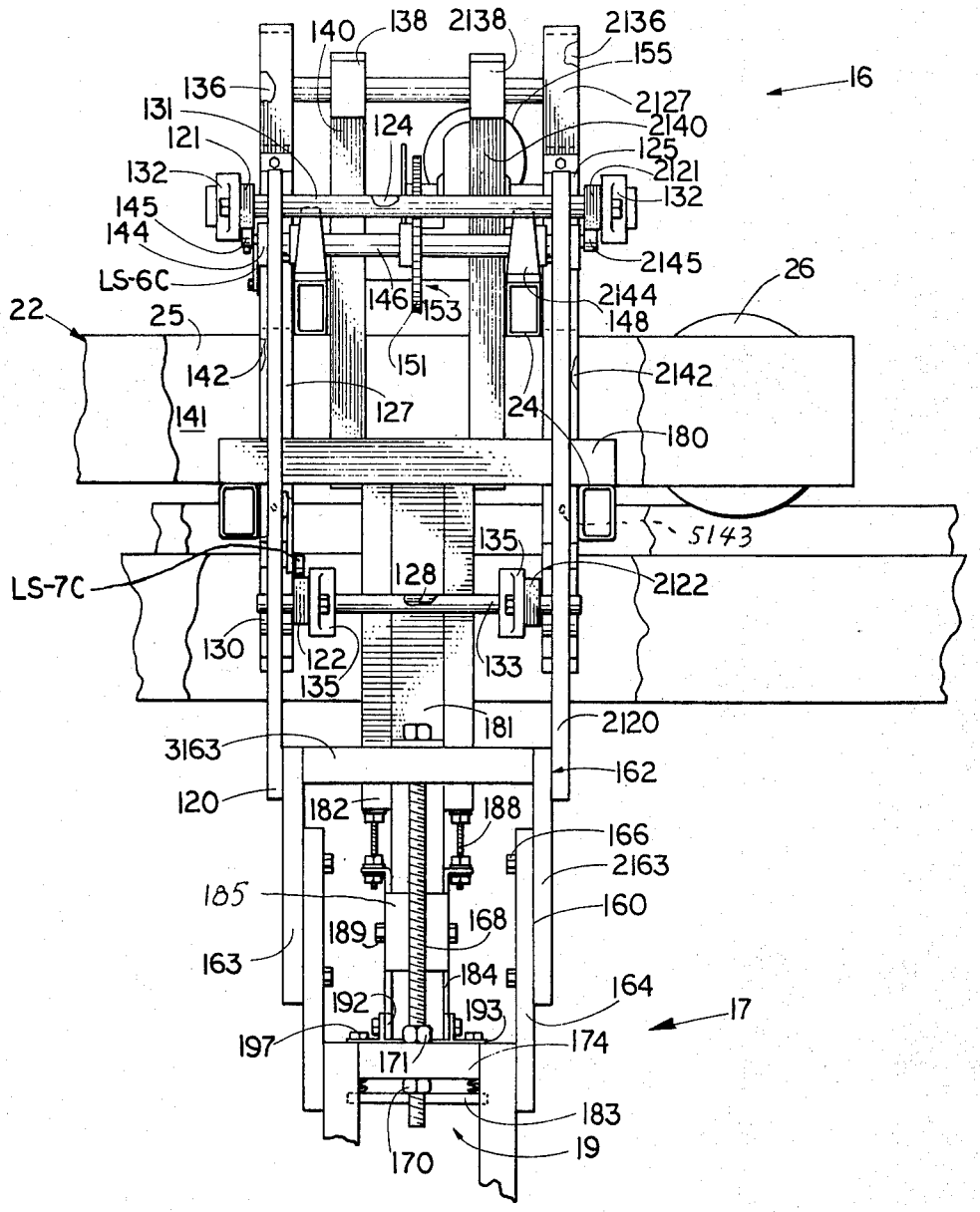
FIG. 7 is a view in end elevation of the crane structure shown in FIGS. 5 and 6 taken in the direction of the arrows 7—7 in FIG. 6.

General details of the automated crane 14 are shown in FIGS. 1 and 2 and greater detail is shown in FIGS. 5, 6, and 7. Referring to FIGS. 5–7, the upper section 16 of the crane 15 is generally a parallelogram support structure for the lower section 17. The parallelogram structure provides the vertical movements necessary to load and unload the fork lift 20. The parallelogram support assembly 16 is also pivotally mounted in such a way to provide a small horizontal movement of the crane 17 in the event that the fork lift 20 improperly impacts the pallet 13 or the pallet stand 12.

More specifically, the lower crane assembly 17 is suspended from a pair of vertical members 120 and 2120. The members 120 and 2120 are held in vertical disposition by a pair of upper pivot arms 121 and 2121 and a lower pair of pivot arms 122 and 2122. The pivot ends of the pivot arms 121 and 2121 are rigidly clamped to a lateral shaft 124. The shaft 124 is rotatably mounted on a set of bearings 125. The set of bearings 125 is mounted on a pair of vertical support members 127 and 2127. The pivot ends of the lower arms 122 and 2122 are rigidly clamped to a lateral shaft 128.

A set of bearings 130 provides rotation of the shaft 128 and of the arms 122 and 2122. The free ends of the upper arms 121 and 2121 are rotatably connected to the vertical members 120 and 2120 by means of a lateral shaft 131 and a pair of bearings 132 that are rigidly attached to the free ends of the upper pivot arms 121 and 2121. The free ends of the lower pivot arms 122 are likewise rotatably connected to the vertical members 120 by means of a lateral shaft 133 that is bearinged to the free ends of the lower arms 122 and 2122 by a pair of bearings 135 (FIG. 7). This arrangement of parts permits small vertical movements of the members 120 and 2120 and therefore of the lower crane assembly 17 that is necessary for loading and unloading the fork lift 20.

The vertical support members 127 and 2127 (FIG. 5) function as a relatively fixed reference plane for the movements of the parallelogram assembly 16 hereinafter described in detail. The vertical support members 127 and 2127 are rotatably mounted about their upper ends by means of a set of bearings 136 and 2136 (FIG. 6). The bearings 136 and 2136 carry a shaft 137. The shaft 137 is held in fixed position by a pair of pillow blocks 138 and 2138. The pillow blocks 138 and 2138 are fixedly attached to a pair of vertical mounting members 140 and 2140. The vertical mounting members 140 and 2140 are fixedly attached to a face 141 of the transverse beam assembly 25 of the upper truck system 22. Another pair of lower vertical mounting members 142 and 2142 (FIG. 7) are likewise rigidly affixed to the face 141 of the transverse beam assembly 25 but in line with the vertical support member 127. If the fork lift 20 engages an improper object, the longitudinal force produced at the fork 20 will be transferred into a movement or rotation of the vertical support members 127 and 2127 (FIG. 5) about the shaft 137. This rotation will move the lower end of the vertical support members 127 and 2127 away from the lower end of the lower vertical mounting members 142 and 2142. A limit switch LS-13C will be opened. The limit switch LS-13C shuts off the longitudinal motor driving of the mobile mounting structure. Compression springs 5142 (FIG. 7) urge the vertical support members 127 and 2127 to the position shown. The springs 5142 are mounted on pins 5143 carried by supports 5144.

Control over the vertical movement of the parallelogram support structure is provided by a pair of cranks 144 and 2144 that turn a pair of rollers 145 and 2145 against the upper pivot arms 121 and 2121 adjacent to the vertical members 120 and 2120 (see FIG. 5). The cranks 144 and 2144 are rigidly attached to a shaft 146 that is carried rotatably by a pair of bearings 148. The bearings 148 are rigidly attached to the upper pair of longitudinal box beams 24. The box beams 24 (FIG. 7) are carried by the transverse beam assemblies 25 and provide a fixed reference upon the upper truck assembly 22 for the rotation of the cranks 144 and 2144. Rotation of the cranks 144 and 2144 is caused by a motor 155 (FIG. 5) mounted on beams 149 that are affixed to the upper pair of longitudinal box beams 24. The motor 155 turns a sprocket 150 that is coupled by a chain 151 to a larger sprocket 153 that is affixed to the shaft 146.

Referring to FIGS. 5 and 7, the cranks 144 and 2144 are in a neutral position. When the motor 155 turns the cranks 144 and 2144 counterclockwise, as shown in FIG. 5, the rollers 145 and 2145 will rotate the pivot arms 121 and 2121 up, raising the vertical members 120 and 2120 until the actuating arm of a limit switch LS-7C is raised. Raising thereof stops the motor 155. When the motor 155 is again turned on, it will resume turning the cranks 144 and 2144 counterclockwise, until the actuator arm of the limit switch LS-6C is lowered. Lowering thereof again turns the motor 155 off.

As already pointed out, the lower section 17 or crane section includes a vertically disposed structure 18, a stack clamp 19 and a fork lift 20. The vertical structure 18 includes a height adjustment assembly 160, and a crane structure 161. The height adjustment assembly 160 includes a mounting yoke 162 (FIGS. 5 and 7) rigidly affixed to the lower extremity of the vertical support members 120 and 2120. The yoke 162 includes a pair of angle-shaped beams 163-2163 and a lateral member 3163, and an adjustment fork 164 rigidly mounted to the top of the crane structure 161. The adjustment fork 164 is slidably mounted to the yoke 162 by a set of bolts 166 screwed into the yoke 162 through a set of slots 167 in the fork 164. Adjustment of the crane height is achieved through a jack screw 168 rigidly inserted through the lateral member 3163 of the yoke 162 and slidably mounted through the top portion of the crane structure 161. A nut 170 (FIG. 7) is turned, either raising or lowering the crane structure 161. A nut 171 is turned down compressively on the top of the lateral member 3163 locking the assembly 161 in place. The crane structure 161 includes a pair of vertical beams 173 and 2173 welded in lateral spaced relationship by three horizontal beams; a top beam 174, a lower beam 175 and a bottom plate 176. Rotatably mounted between the beams 173 and 2173 at their lower ends is the compression plate 119, which actuates a limit switch LS-10C through arm 178 when the crane 15 moves under the stack 9 to pick it up. The switch LS-10C turns off the longitudinal crane motor thus stopping longitudinal movement of the crane assembly 15. The crane structure 161 provides a back stop for uneven stacks of cartons 9.

The stack clamp 19 (FIG. 5) is an integral part of the lower crane section 17, but is rigidly attached to the lower longitudinal box beams 24. The stack clamp 19 is mounted on lower beams 24 by a lateral beam 180. A vertical box beam 181 is rigidly affixed to the beam 180 and provides mounting and adjustment for the stack clamp assembly 19. The vertical beam 181 with the addition of a pair of flanges 182 (FIGS. 5 and 7), provides reference for the vertical adjustment of a clamp plate 183. A pair of flanges 184 are held in fixed relationship by a pair of plates 185 forming a slidable square collar that slides over the lower end of the vertical beam 181. The vertical height is adjusted by means of a pair of jack screws 188 rigidly bolted in the flanges 184 and slidably clamped in the flanges 182. A bolt and nut 189, located in a hole through the member 181 and slidable in the flanges 184 by means of a slot 190 (FIG. 5), locks the flanges 184 in place. The clamp plate 183 is longitudinally adjustable by means of holes 191 in a pair of rails 192 which are attached to the flanges 184. The clamp plate 183 is mounted to an upper clamp plate 193 by a set of springs 194. A pair of parallel rails 196 is welded to the upper plate 193 to provide alignment and clamping of the assembly in place by a set of bolts 197 through the holes 191. This provides longitudinal adjustment of the clamp 19 to accommodate different carton sizes. As the fork and crane assembly, lower section 17, is raised by the action of the cams 144 and 2144, the carton stack 9 is raised into contact with the clamp plate 183, compressing springs 194 and consequently securing the stack of cartons 9 on the fork lift 20.

Figure 7A:
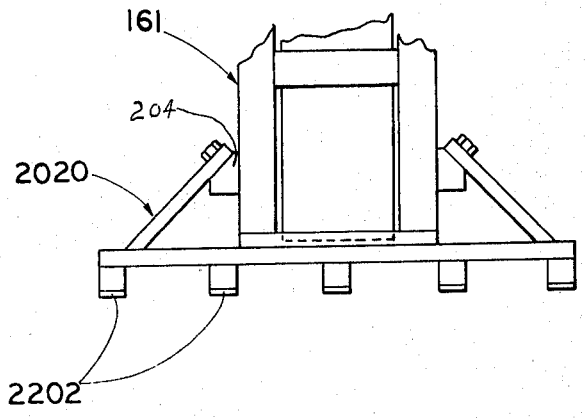
FIG. 7A is a fragmentary view in end elevation of the crane structure showing an alternate fork.

The fork 20 includes a mounting yoke 200, a set of spacer blocks 201 and a set of tongues 202 as shown in FIGS. 5 and 7. The fork 20 can be interchangeable with a fork 2020 (FIG. 7A) including additional tongues 2202 as required. The assemblies 2202 and 20 are bolted to a pair of mounting blocks 204 that are welded to the crane structure 161.

Figure 8:
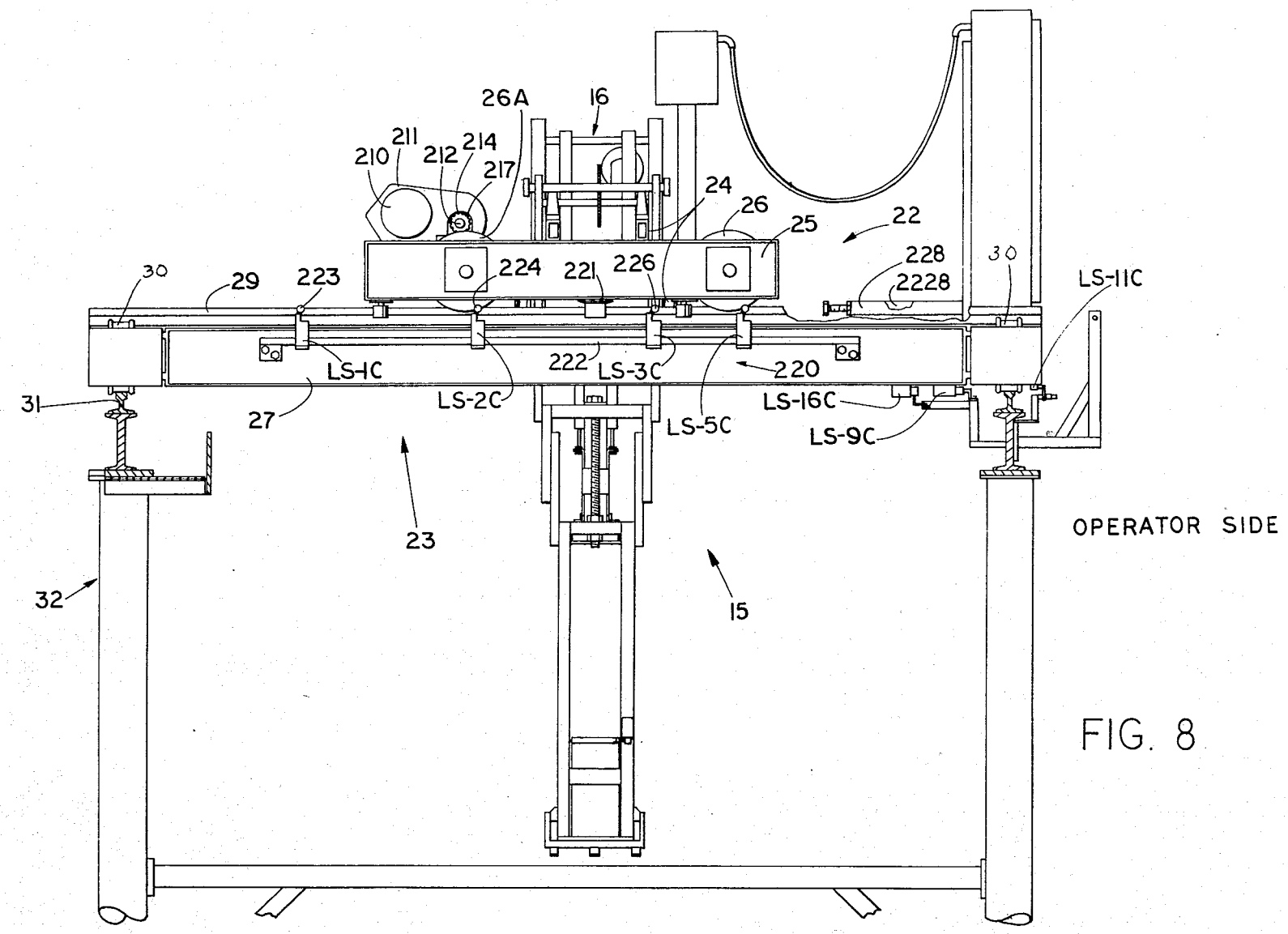
FIG. 8 is a view is section taken on the line 8—8 in FIG. 1.

The crane 17 follows the path shown by dashed arrows 205 in FIG. 2 and is supported by means of the mobile mounting structure 21. Referring to FIGS. 1, 2, 5, 6, and 8, the upper truck assembly 22 of the mobile mounting structure 21 includes the longitudinal box beams 24 (FIGS. 5 and 6) supported by the transverse "I" beam assemblies 25. The rollers 26 (FIG. 8) are rotatably mounted upon the beams 25. The rails 29 support the rollers 26. The upper truck assembly 22 is moved along the rails 29 by a motor 210 which drives gears (not shown) in a gear box 211 to turn a shaft 212. A pair of gears 214 are rigidly attached to the ends of the shaft 212 and intermesh with a pair of wheel gears 215 (FIG. 2). The wheel gears 215 are integral with a pair of wheels 26A in the set of rollers 26. The shaft 212 is rotatably held in place by a pair of bearings 217. The motor 210 is supported on a beam 218 that is rigidly fixed to the ends of the transverse beam assembly 25. The transverse movement of the upper truck 22 is controlled by a series of limit switches LS-1C, LS-2C, LS-3C, and LS-5C (FIG. 8) clamped to a slide bar 222 mounted on the transverse beam assembly 27 of the lower truck assembly 23 (see FIGS. 2 and 8). A limit switch trip 221 is located on the underside of the transverse beam assembly 25. As the upper truck 22 moves to the left as shown in FIG. 8, the switch trip 221 will contact a switch arm and roller 223 of a limit switch LS-1C, rotating it in a counterclockwise direction. This direction makes the circuit in association with the switch LS-1C, thereby shutting off power to the motor 210. The switch LS-1C is so situated that the crane 15 is in line with the first stack of cartons 9 (FIG. 2) in the array 14. Under circumstances where the truck 22 is moving from the left stop position at LS-1C toward the right as shown in FIG. 8, the switch trip 221 will come into contact with a switch arm and roller 224 of the limit switch LS-2C, rotating the switch arm and roller 224 clockwise, thereby making the circuit associated with the switch LS-2C and stopping the motor 210. The upper truck 22 is now in a proper lateral position to pick up a second stack of cartons 9A (FIG. 2) from the array 14. After the second stack of cartons has been delivered to the deposit table 36, a stepper switch (not described in detail) electrically disengages the limit switch LS-2C and engages in the circuitry a limit switch LS-3C. As the upper truck 22 leaves the LS-1C position, it will travel past limit switch LS-2C uninterrupted and proceed to LS-3C (FIG. 8) where the switch trip 221 will rotate a switch arm and roller 226 in a clockwise direction. This rotation will actuate the associated circuit to turn off the motor 210, thereby stopping the crane 15 in line with the third stack of cartons 9 in the array 14. After the carton stack has been secured on the crane 15, the truck 22 will move to the left. As it proceeds, the trip 221 will rotate the switch arm and roller 224 of the switch LS-2C counterclockwise. The switch LS-2C is inert for rotations in this direction, and the truck 22 will proceed until the motor 210 is turned off by the limit switch LS-1C. The crane 15 stays in this lateral position until the deposit portion of the cycle is reached. The crane 15 again moves to the right from the LS-1C position, passes switches LS-2C and LS-3C and continues moving to the right until it reaches a deposit switch LS-5C which again disengages the motor 210 halting the truck 22. Switch LS-3C is also inert when triggered in the counterclockwise direction.

Limit switches LS-1C, LS-2C and LS-3C are adjustable along the bar 222 to cooperate with various sizes of cartons and different numbers of stacks 9 in the carton array 14. LS-5C need not be changed once the machine has been set up.

A pair of mechanical stops 228 and 2228 (FIGS. 2 and 8) is installed on the lower truck 23 to stop the upper truck 22 by impacting the lower box beam 24, as shown in FIG. 8, should the electrical circuit malfunction.

Figure 9:
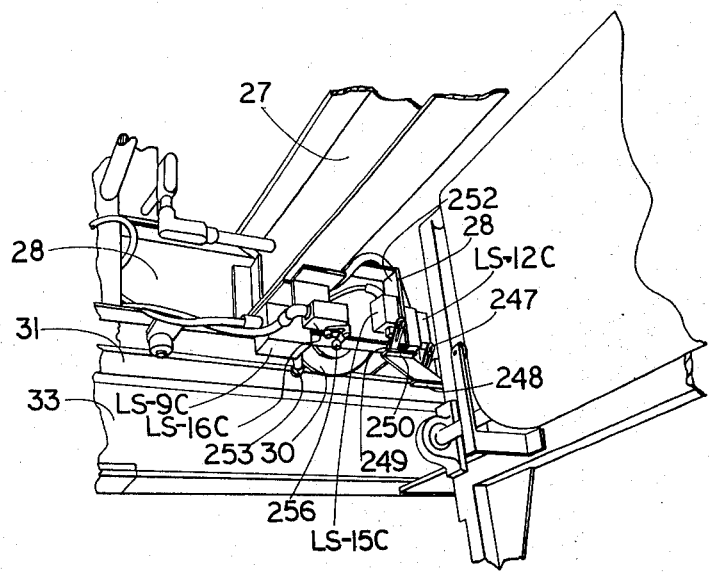
FIG. 9 is a fragmentary perspective view showing details of crane supporting mechanism and limit switch positions.

The lower truck assembly 23 supports and moves the upper truck assembly 22 longitudinally as shown in FIG. 2. Referring to FIGS. 1, 2, and 8, the lower truck assembly 23 includes the set of transverse beams 27 and the assembly of longitudinal beams 28 (FIG. 2). The rollers 30 are rotatably mounted upon the beams 28 for mobility thereof. The mobile mounting structure 21 is supported by and moves upon the pair of rails 31 of the overall truck support assembly 32. The lower truck 23 is moved along the rails 31 by means of a motor 230 (FIGS. 1 and 2), in association with gears (not shown) in a gear box 231 that turns a shaft 232. A pair of gears 233 are rigidly attached to the ends of the shaft 232 and intermesh with a pair of wheel gears 237 (FIG. 2). The wheel gears 237 are integral with a pair of wheels 30A of the set of rollers 30. The shaft 232 is rotatably held at its ends by a pair of bearings 235 and supported at its center by a third bearing 236. The bearing 236 is mounted on a cantilever beam 238 that is rigidly fixed to the transverse beam 27 providing support to the motor 230 and gear box 231. Torque restraint and support is also provided by a transverse beam 239 that is rigidly fixed to the ends of the longitudinal beam assemblies 28. A torque arm 240 is provided therebetween. The longitudinal movement of the lower truck 23 is controlled by a group of limit switches LS-9C, LS-11C, LS-12C, LS-15C, and LS-16C, all of which are shown in FIG. 2 or in FIG. 9, and which are arranged along the side of the machine designated "operator side" in FIG. 2. Details of these switches are also shown in FIGS. 8 and 9. Referring to FIG. 2, the crane 15 starts at a home position 245. This position is also the start position, that is, the crane is loaded and in the up position. It is also called the deposit position, for the first command from the sequential programmer calls for the upper truck 22 to move the crane toward the deposit table as already described. When the lower truck assembly 23 is at the deposit position, a longitudinal position, the limit switch LS-12C is actuated. As shown in FIG. 2, the switch LS-12C is rigidly fixed on the right end of the longitudinal beam 28 on the operator side of the machine. As the lower truck 23 approaches the deposit position, a switch arm and roller 247 (FIG. 9) contacts a trip 248 which rotates the arm and roller 247 clockwise, making the circuit in association with the motor 230 which thereby stops the lower truck 23. The switch LS-15C is mounted on the inside of an end plate 252 of the longitudinal beam 28. As the lower truck 23 approaches the deposit position, a switch arm and roller 249 of the switch LS-15C contacts and rides up on a trip 250 rotating the arm and roller clockwise, which makes the circuit to the motor 210 and permits lateral movement of the upper truck if LS-7C (FIG. 5) is also made, indicating the automated crane 15 in the up position.

An index position 251 (FIG. 2), a longitudinal position is a pause position to permit the upper truck 22 to laterally index to the proper carton stack before advancing toward the stack. When the crane 15 is at this position, the switch LS-9C is actuated. As the truck 23 moves from the home position 245 toward the carton array 14, a switch arm and roller 253 (FIG. 9) of the limit switch LS-9C contacts a trip 255 (FIG. 2) mounted on the longitudinal beam 33 to control the circuit to motor 230, and stops the crane 15 in its index longitudinal position 251.

A safety switch LS-16C is also provided which incorporates a two-headed L-shaped switch arm and roller actuator 256 as shown in FIG. 9. The actuator 256 contacts a switch trip 257 (FIG. 2) shortly before the switch LS-9C is actuated as the crane moves toward the pallet stand 12 and shortly after the switch LS-9C is actuated when the crane moves toward home position. The switch LS-16C is a make and maintain switch and is not spring loaded for automatic return. The circuit associated with this switch is thereby set up to stop longitudinal advance if there is a malfunction in the forthcoming step. After indexing has occurred, the motor 230 is started and moves the crane 15 toward the pallet 13. If no cartons are present, the motor 230 will run until the lower truck 23, which carries the end of travel switch LS-11C on an end 258 of the beam assembly 28, has moved sufficiently that the switch LS-11C contacts a switch trip 259 turning off the motor 230. In this situation a manual reset is necessary. Otherwise, the crane 15 will contact a carton stack 9 which trips the switch LS-10C (FIG. 5) that stops the motor 230 and continues with the stack pickup. The motor 230 is again started when the stack is clamped in the crane 15 and moves the lower truck 23 back toward the index position 251 (FIG. 2). The switch LS-9C trips first, stopping the truck 23 at the index position. If the switch LS-9C fails, the switch LS-16C trips in close sequence and stops the motor 230 before the crane 15 can run into the tipover device 40.

The mobile mounting structure 21 is supported by and moves upon the pair of rails 31 of the overall truck support assembly 32. The overall truck support assembly 32 includes the pair of longitudinal beams 33 that support the rails 31. The set of pillars 34 supports the beams 33 in fixed relationship with other major parts of the feeder machine 10.

DEPOSIT TABLE AND TIP-OVER

Figures 10, 10A:
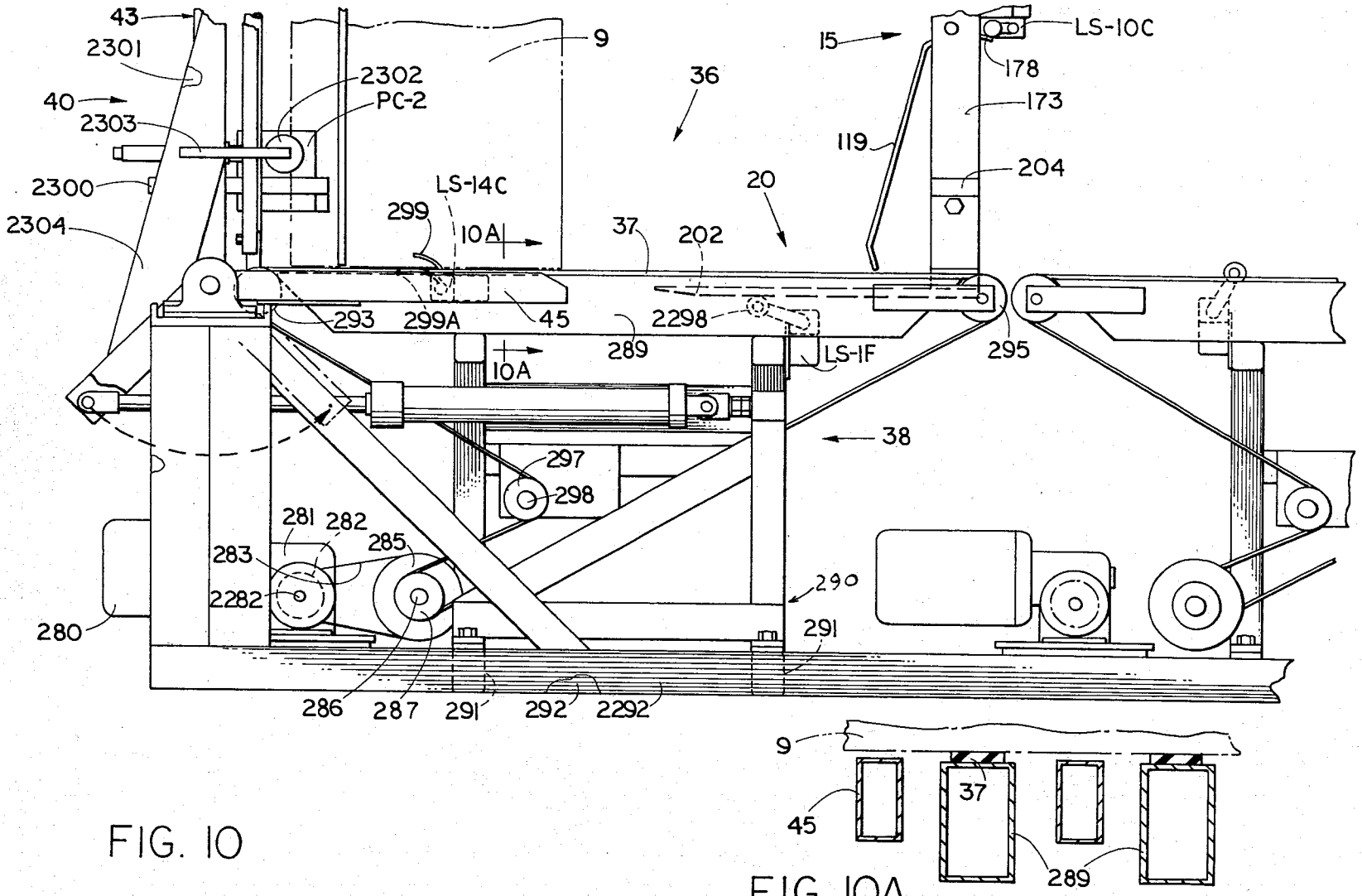
FIG. 10 is a view in side elevation looking in the direction of the arrows 10—10 in FIG. 2 with the tip-over table being shown in raised position.
FIG. 10A is a fragmentary view in section on an enlarged scale on the line 10A—10A in FIG. 10.

The automated crane 15 delivers the stack of cartons 9 to a fixed drop position at the deposit table 36. Details of construction of the deposit table 36 are shown in FIG. 10. The deposit table 36 is comprised of the set of six timing belts 37 and the support structure assembly 38. The timing belts 37 are driven by a motor 280 in association with a gearing (not shown) in a gear box 281 that drives a sprocket 282 mounted on a drive shaft 2282. A chain 23 connects the sprocket 282 and a larger sprocket 285 that is rigidly affixed to a shaft 286 supplying power thereto. A set of six notched drive rollers 287 are spaced uniformly along the shaft 286. Each of the rollers 287 is associated with and drives one of the sets of belts 37. The timing belts 37 are held in place by the support structure assembly 38. The assembly 38 includes a set of six slide rails 289 (FIGS. 10 and 10A) held in rigid horizontal position by a table-like structure 290 (FIG. 10). The structure 290 is rigidly attached to a pair of cross members 291 that are welded to longitudinal bottom mounting frames 292 and 2292. A set of notched rollers 293, rotatably mounted at the left-hand ends of the slide rails 289, and a set of notched rollers 295, rotatably mounted at the right-hand ends of the slide rails 289, in cooperation with a set of takeup rollers 297 rotatably mounted on the table structure 290 by means of a set of spindles 298 and the drive rollers 287, provides movement of the belts 37 in either direction by reason of the motor 280.

The automated crane 15 is shown in its deposit position in FIG. 10. The forks 202 are shown inserted between the slide rails 289, a center one of the forks 202 depressing a switch actuator 2298 of a limit switch LS-1F which starts the motor 280 to drive the belts 37 in a counterclockwise direction. The stack of cartons 9 that is now resting on the belts 37 moves from the fork lift 20 and proceeds to the left as shown in FIG. 10, overriding a limit switch arm 299 of a limit switch LS-14C depressing it to a position 299A, and comes to rest as it breaks a light beam of a photocell PC-2. The photocell PC-2 is supported on a bar 2300 attached to a frame element 2301 of a back support 43 of the stack straightening or tip-over device 40. A target 2302 FIG. 10 for the photocell PC-2 is supported on a bar 2303 carried by a frame element 2304 of the back support 43. The limit switch LS-14C (FIGS. 2 and 10) is located on the center finger of horizontal pickup fingers 45, also a part of the straightening or tip-over device 40. The stack straightening device 40 will hereinafter be called the tip-over. Closing of the switch LS-14C indicates that a stack 9 is present on the tip-over 40.

The machine illustrated in the drawings and described above is subject to structural modification without departing from the spirit and scope of the appended claims.

Having described our invention, what we claim as new and desire to secure by letters patent is:

1. A crane assembly for removing a stack of articles from a pallet which comprises a carriage mounted for movement above the pallet toward and away from the pallet lengthwise of slots in the pallet, a crane member including an upright frame extending downwardly from the carriage and forks mounted at the lower end of the upright frame perpendicular thereto, the forks being spaced to enter the slots in the pallet underlying the stack, a table having spaced conveyor belts adjacent the pallet, a pair of vertically spaced substantially horizontal links, means pivotally connecting one end of each of the links to the upright frame, means for pivotally connecting an opposite end of each of the links to the carriage, cam means engaging one of the links, means for turning the cam means to cause raising of the links and of the crane member when the forks underlie the stack to raise the stack from the pallet, means for moving the carriage to advance the crane member from the pallet to a deposit position overlying the table, and means for lowering the crane member to permit the forks to enter between the conveyor belts to deposit the stack on the conveyor belts.

2. A crane assembly as in claim 1 wherein there is means for advancing the conveyor belts to remove the stack from the crane member when the stack is deposited on the conveyor belts.

3. A crane assembly as in claim 1 wherein there is an upright plate mounted on the upright frame and engageable by the stack as the crane is advanced toward the stack on the pallet, and switch means operated by the upright plate for stopping advance of the carriage and for causing raising of the crane member.

4. A crane assembly as in claim 1 wherein the means for pivotally connecting an opposite end of each of the links to the carriage includes an upright crane support frame pivotally mounted on the carriage, the opposite end of each of the links being pivotally connected to the upright crane support frame, means for urging the upright crane support frame to a normal upright position, the upright crane support frame swinging away from normal position when the crane engages an obstacle, and switch means actuated by the upright crane support frame to stop advance of the carriage when the upright crane support frame swings out of normal position.

5. A crane assembly as in claim 1 wherein the carriage is mounted for movement both lengthwise of the slots in the pallet and crosswise of the slots in the pallet, and the crane is adapted to pick up stacks at a plurality of stations on the pallet.

6. A crane assembly as in claim 1 wherein there is a horizontal hold-down plate mounted on the carriage overlying the forks, and the hold-down plate engages the upper end of the stack when the crane member is in raised position to hold the stack on the forks.

7. A crane assembly as in claim 6 wherein there is means on the carriage resiliently urging the hold-down plate downwardly so that the hold-down plate resiliently engages the upper end of the stack.

* * * * *